United States Patent [19]

Busch et al.

[11] Patent Number: 4,585,563

[45] Date of Patent: Apr. 29, 1986

[54] GRANULAR DETERGENT COMPOSITIONS CONTAINING ORGANO-FUNCTIONAL POLYSILOXANES

[75] Inventors: Alfred Busch, Strombeek-Bever, Belgium; Sardelis Kosmas, Athens, Greece

[73] Assignee: The Procter & Gamble Company, Cincinnati, Ohio

[21] Appl. No.: 689,627

[22] Filed: Jan. 8, 1985

[30] Foreign Application Priority Data

Jan. 13, 1984 [GB] United Kingdom ..... 8400899

[51] Int. Cl.[4] ..... D06M 15/643; D06M 13/34

[52] U.S. Cl. ..... 252/8.8; 174.15/525; 174.15/544

[58] Field of Search ..... 252/8.8, 8.9, 174.15, 252/525, 528, 544, 547

[56] References Cited

U.S. PATENT DOCUMENTS

| | | | |
|---|---|---|---|
| 3,933,672 | 1/1976 | Bartolotta et al. | 252/116 |
| 4,139,546 | 2/1979 | Berger et al. | 252/174.15 |
| 4,247,592 | 1/1981 | Kalinowski | 428/266 |
| 4,359,545 | 11/1982 | Ona et al. | 524/262 |
| 4,446,034 | 5/1984 | Kolbe et al. | 252/8.8 |
| 4,448,810 | 5/1984 | Westall | 252/8.8 |
| 4,474,668 | 10/1984 | Petzold et al. | 252/8.8 |
| 4,511,489 | 4/1985 | Requejo et al. | 252/174.15 |

FOREIGN PATENT DOCUMENTS

| | | |
|---|---|---|
| 036996 | 3/1978 | Japan . |
| 1296136 | 11/1972 | United Kingdom . |
| 1549180 | 7/1979 | United Kingdom . |

*Primary Examiner*—Paul Lieberman
*Assistant Examiner*—Willie J. Thompson
*Attorney, Agent, or Firm*—Robert B. Aylor; Richard C. Witte; Thomas H. O'Flaherty

[57] ABSTRACT

Granular built detergent compositions containing additive levels of organo-functional polysiloxanes are disclosed. The siloxanes are derived from poly-di-short-alkyl siloxanes by substituting part of the alkyl moieties by specific organo-functional groups, preferably amino-groups, with the proviso that the degree of substitution is in the range from 0.01–0.7. The granular detergent compositions herein unexpectedly provide through-the-wash softening benefits comparable to what can be obtained from the utilization of conventional cationic rinse-softeners. An additional benefit originates from the "dry-softening" feel of the composition herein as compared to the "greasy" feed conferred by conventional cationic rinse softeners.

8 Claims, No Drawings

GRANULAR DETERGENT COMPOSITIONS CONTAINING ORGANO-FUNCTIONAL POLYSILOXANES

This invention relates to particulate built detergent compositions containing low levels of selected organo-functional polydialkylsiloxanes. In more detail, the compositions herein comprise conventional matrix ingredients inclusive of surface-active agents, detergent builders, optional ingredients and low levels of organo-functional polydi-short alkylsiloxanes. The latter ingredient unexpectedly provides desirable through-the-wash textile benefits inclusive of softness. The preferred siloxanes embrace amino derivatives. The essential siloxanes are further characterized by a degree of substitution in the range from 0.01–0.7.

The through-the-wash textile benefits conferred by the inventive compositions, in addition to softening, are frequently perceived in terms of anti-static, ease-of-ironing and anti-wrinkling benefits. Additionally, some unexpected cleaning benefits were found. On a conservative basis, it was established that, at least, and contrary to standing prejudice, the essential siloxane components do not, adversely affect the general textile cleaning suitability of the compositions herein.

The prior art relative to the textile-treatment utilization of silicones/polydialkylsiloxanes is crowded and diverse. The like siloxanes have, for example, found widespread commercial application in a detergent suds regulant functionality. Silicon polymers have also found widespread application in the textile industry to provide fiber properties inclusive of softness, water proofing and easy ironing. To that effect the silicon polymers are applied (in the textile industry) to the fabrics during manufacture or during make-up of clothing, in the form of relatively concentrated dispersions or solutions either by padding or spray-on. Often, especially for long lasting softness, water proofing treatment or other benefits, mixtures or organofunctional polydialkylsiloxanes were used. The fabrics were subsequently treated with catalysts or heated to cause crosslinking or setting of the silicone polymers.

German Pat. No. 27 54 504 and U.S. Pat. No. 4.247.592 disclose a treating agent consisting of a polydimethylsiloxane containing diaminoalkyl groups for providing softness to natural and synthetic fabrics.

Japanese Pat. No. 79,131,096 pertains to a treating agent consisting of a mixture of polydimethylsiloxane with NHR-groups and a polydimethylsiloxane with hydroxy end groups, for providing softness to acrylics. The fabrics were spray coated and then heated for curing.

German Pat. No. 20 16 095 uses polydimethylsiloxane containing pendant epoxy groups for providing softness and smoothness to synthetic organic fabrics.

European Pat. No. 058 493 relates to a treating agent mixture of an organo polysiloxane containing diaminoalkyl and polyoxyalkylene groups, with an organopolysiloxane containing carboxylic acid ester groups or with an organopolysiloxane containing epoxy and polyoxyalkylene groups. The mixture was added by spray-on and treated for curing. It was claimed to provide softness, anti-wrinkling and long lasting electrostatic prevention benefits.

German Patent application DOS No. 26.31.419 relates to fabric rinse softening compositions containing a fabric-substantive cationic component and a polydimethylsiloxane. The mixture is applied as an aqueous dispersion.

The suds regulant utilization of polydimethylsiloxanes is known from German Patent specification DOS No. 23.38.468.

It is also known that the detergent incorporation of polydimethylsiloxane suds regulants can adversely affect textile cleaning benefits.

It has now been found that specific organo-functional polydialkylsiloxanes, preferably aminosubstituted species, can advantageously be incorporated in granular detergents to provide remarkable benefits inclusive of through-the-wash softening and further textile handling improvements. The essential means needed to achieve these unexpected properties are explained in more detail hereafter.

SUMMARY OF THE INVENTION

This invention is based on the discovery that particulate detergent compositions capable of simultaneously providing fiber-cleaning and textile handling benefits, inclusive of softness, can now be formulated containing conventional matrix components and an organo-functional siloxane.

In particular, the compositions herein comprise:

(a) from 1% to 30% by weight of a surface-active agent;

(b) from 4% to 50% by weight of a detergent builder; and, if desired, (c) optional ingredients inclusive of silicon suds regulant and/or cationic fabric softeners, characterized in, that they contain:

(d) from 0.05% to 5% by weight of an organo-functional polydi-$C_{1-4}$-alkyl siloxane textile treatment agent having the general formula:

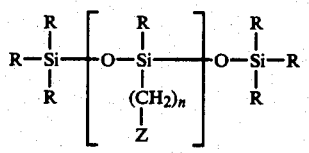

wherein

R=$C_{1-4}$-alkyl; n is an integer from 1 to 6;

Z is

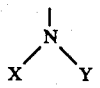

whereby X and Y are, selected independently,. —H; —$C_{1-30}$-alkyl; —$C_6$-aryl; —$C_{5-6}$-cycloalkyl; —$C_{1-6}$—$NH_2$; —CO—R; with the proviso that the nitrogen can be quaternized such as to represent

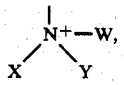

whereby W can be selected from X and Y

Z is H—C—M whereby P and M are —COOH; —CO—NR'2; or —CO—OR' and wherein R' is hydrogen or $H_2C$—P $C_{1-2}$-alkyl;

with further proviso that the degree of substitution, i.e., the molar proportion of silicones carrying a substituent other than a $C_{1-4}$ alkyl group to total silicones is in the range from 0.01 to 0.7.

DETAILED DESCRIPTION OF THE INVENTION

The invention herein comprises, at least, a surface-active agent, a detergent builder and an organo-functional polydialkylsiloxane textile treatment agent. These major variables of the invention are described in more detail hereinafter.

Unless indicated to the contrary, the "percent" indications stand for "percent by weight".

A first essential component for use in the compositions of this invention is represented by a surface-active agent which can be present in an amount from 1% to 30%, preferably from 2% to 10%.

Suitable species of surface-active agents for use herein are disclosed in U.S. Pat. No. 4,192,761, column 8, line 56 to column 9, line 68, this passage being incorporated herein by reference.

Another essential component herein is a detergent builder which is normally used in an amount from 4% to 50% preferably from 8% to 35%. The builder component can be represented by all watersoluble and waterinsoluble detergent builders which are known to be suitable for use in detergents and have, in part, found widespread commercial application.

Examples of suitable watersoluble detergent builders include alkali-phosphates and polyphosphates, specifically sodium tri-polyphosphate, silicates, carbonates, polycarboxylates, such as nitrilotriacetate, and citrate, fatty acid soaps and watersoluble polycarboxylate builders such as polyacrylates, polymaleates and copolymeric carboxylates including those obtained from the copolymerization of unsaturated polyacids such as maleic or citraconic acid with suitable polymerisable reaction partners such as methacrylic acid, acrylic acid, mesaconic acid and methyl-vinyl-ether. Mixture of the like watersoluble detergent builders can also be used.

Examples of suitable waterinsoluble detergent builders include synthetic crystalline Zeolites A, X and P as described in more detail in German patent application DE-OS No. 24.22.655, and amorphous aluminosilicate builders or mixtures of crystalline and amorphous aluminosilicates. It can, depending upon the circumstances be desirable, to utilize mixtures of watersoluble detergent builders and waterinsoluble detergent builders. A preferred mixture of the like waterinsoluble and watersoluble detergent builder is represented by a combination of completely hydrated ZEOLITE A, having a particle diameter in the range from 1–10 microns, with sodium tripolyphosphate and/or sodium nitrilotriacetate in a weight ratio of waterinsoluble builder to watersoluble builder in the range from 1:2 to 2:1.

The essential organo-functional siloxane for use herein can be present in levels from 0.05% to 5%, preferably from 0.1%–3%, and most preferably from 0.15%–1%. Using levels below 0.05% will not anymore produce, to any noticeable extent, the claimed benefits whereas the incorporation of levels exceeding 5% will not produce additional benefits commensurate with (proportional to) the level increase.

The organo-functional-polydi-$C_{1-4}$-alkyl siloxane component can stoichlometrically be defined with the aid of the following formula:

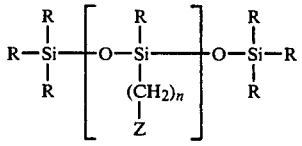

wherein

R = $C_{1-4}$-alkyl; n is an integer from 1 to 6;

Z is

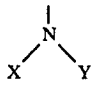

whereby X and Y are, selected independently, —H; ; —$C_{1-30}$-alkyl; —$C_6$-aryl; —$C_{5-6}$-cycloalkyl; —$C_{1-6}$—$NH_2$; —CO—R; with the proviso that the nitrogen can be quaternized such as to represent

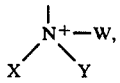

whereby W can be selected from X and Y or

Z is

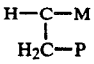

whereby P and M are —COOH; —CO—$NR'_2$; or —CO—OR' and wherein R' is hydrogen or $C_{1-2}$-alkyl; with the proviso that the degree of substitution, i.e. the molar proportion of silicones carrying a substituent other than a $C_{1-4}$alkyl group to total silicones is in the range from 0.01 to 0.7. The siloxane component is preferably represented by amino-functional polydialkylsiloxanes which are frequently used in levels from 0.1% to 3%, more preferably from 0.15–1.0%.

The degree of substitution of preferred siloxanes, such as the aminosiloxanes, can be expressed as the molar (moiety) proportion of non-terminal silicones carrying a substituent other than a $C_{1-4}$ alkyl group to total non-terminal silicones. The numerical value for the degree of substitution of preferred siloxanes lies in the range from 0.01 to 0.7; preferably from 0.02 to 0.3. While non-terminal substitution is preferred for enhanced through-the-wash fiber substantivity, it is understood that siloxanes with substituted terminal silicone atoms can also be used.

In the preferred siloxane component herein, n is 3 or 4, X and Y are, selected independently, hydrogen; —$C_{1-4}$-alkyl; —$C_{5-6}$-cycloalkyl and —$C_2$—$NH_2$.

Preferred organofunctional polydimethyl siloxanes include aminofunctional siloxanes, such as:

(N-cyclohexylamino-4-amino-butyl-1)polydimethylsiloxane.

(Ethylene diamino-N-butyl-1)polydimethylsiloxane.

(N-dodecyl-4-amino-butyl-1)polydimethylsiloxane.

(4-(N,N-dimethyl ammonium)-butyl-1)polydimethylsiloxane.

(5 (tallow amide)-4-carboxy-pentyl-1)polydimethylsiloxane.

The organofunctional siloxanes have generally a viscosity in the range from 40 cSt to 100.000 cSt, preferably from 250 cSt to 2000 cSt. The viscosity of the siloxanes is measured on the pure raw material at 25° C. with the aid of a BROOKFIELD viscometer (LV Digital).

The organofunctional polydimethyl siloxanes, in addition to the essential substituents defined hereinbefore, can contain polyalkylene oxide chains attached to unsubstituted silicone atoms (in the meaning of this invention). The polyalkylene, such as propylene or ethylene, oxide chains are attached to the silicone atoms instead of a $C_{1-4}$ alkyl group. The alkoxylation enhances the hydrophilic and anti-static (charge-reducing) properties of the component in relation to the textiles.

The detergent compositions herein can comprise, in addition to the essential components, a series of supplementary substances to perfect and augment the performance benefits. The additional (optional) components are represented by known ingredients which have already found application in detergency, for their known functionality, in the art established levels. Examples of the like components include peroxygen bleaches, such as perborate mono-or tetrahydrate and percarbonate, oxygen bleach activators such as tetraacetyl ethylene diamine, stabilizers such as magnesium silicate, detergent enzymes such as proteases, amylases, lipases and mixtures thereof, and stabilizing agents for the like enzymes. Other optional components include soil suspending agents such as the sodium salt of carboxymethylcellulose and the sodium salt of methylhydroxypropyl cellulose; through-the-wash softening smectite clays such as alkali montmorillonites, saponites and hectorites, having an ion-exchange capacity of at least 50 m.eq./100 g, and photoactivators, for example, sulfonated metal phthalocyanines such as zinc and aluminium phthalocyanines.

The subject compositions further can comprise suds regulants e.g. those of U.S. Pat. No. 4,192,761 and more in general suds regulants based on silicones, silica, waterinsoluble hydrocarbons, either individually or optimized mixtures thereof, and renewable textile soil release agents such as described in European Patent Applications Nos. 0 042 187 and 0 042 188. Preferred soil release agents include N-hydrogenated tallow $C_{16}$–$C_{18}$-N,N',N'-tri-(2-hydroxyethyl)-propylene-1,3-diamine and N-$C_{12}$–$C_{14}$-coconutalkyl-N,N-dimethyl-N-amine oxide and can be utilized in levels of from 0.1%–1.5%. The claimed compositions also can contain brighteners, perfumes, dyes, bactericidal agents, antioxidants and fillers. A preferred additive system is comprised of a combination of a tertiary amine and an impalpable smectite clay as described in European patent application No. 0 011 340, incorporated herein by reference.

EXAMPLES

The following examples illustrate preferred executions of this invention, and facilitate its understanding.

The abbreviations for the individual ingredients of the examples have the following meaning:

LAS: Sodium salt of linear dodecyl benzene sulfonate.
TAS: Sodium salt of tallow alcohol sulfate.
α-OS: Sodium salt of α-olefin (C12–18) sulfonate.
$FAE_3S$: Sodium salt of fatty alcohol (C12–18) (ethoxy)3-sulfate.
AO: C12–14 alkyl dimethylamine oxide.
TAE-5: Tallow alcohol ethoxylated with about 5 moles of ethylene oxide.
TAE-11: Tallow alcohol ethoxylated with about 11 moles of ethylene oxide.
FA25EX: Fatty alcohol (C12–C15) ethoxylated with X moles of ethylene oxide.
DTMA: Ditallow methyl amine.
CFA: C12–14 coconut fatty acid.
HFA: Hydrogenated C16–22 fatty acid.
STPP: Sodium tripolyphosphate.
Zeolite A: Sodium salt of fully hydrated zeolite 4A(average particle size between 2–6 microns).
NTA: Sodium salt of nitrilotriacetate.
Copolymer: $AA^{40}/MA^{60}$=copolymer of acrylic acid 40 mole-% and maleic acid 60 mole-%.
CMC: Sodium salt of carboxymethylcellulose.
Smectite clay: Natural smectite having a CaCO3 ion-exchange capacity of 95 meq/100 g clay.
Silicate 1.6: Sodium silicate $SiO_2/Na_2O=1.6$.
Silicate 1.0: Sodium metasilicate.
STS: Sodium salt of toluene sulfonate.
EDTA: Sodium salt of ethylene diamine tetra-acetate.
Perborate: $NaBO_3.H_2O_2.3H_2O$.
Photobleach activator: Mixture of sulfonated tetra- and trisulfonated zinc phthalocyanine in a ratio (weight) of tetra or tri of approximately 20:1.
SRS I: Prilled suds regulating system consisting of:
(a) 77.5% STPP;
(b) 22.5% active
13.5% paraffin oil
6% paraffin wax (mp 70° C.);
3% amorphous hydrophobic silica.
SRS II: Prilled suds regulating system consisting of:
(a) 85% STPP;
(b) 15% active
12.7% polydimethylsiloxane
2.3% amorphous hydrophobic silica.
Enzymes: Mixture of proteases and amylases in a ratio of 1:1.

The following granular detergent compositions were prepared by conventional spray-drying of a slurry of most of the individual ingredients, and subsequent dry-mixing of the spray-dried powder with spray-drying sensitive ingredients, namely perborate, aminofunctional polydimethylsiloxane, enzymes, photobleach activator and suds regulating system.

| | COMPOSITIONS (% by weight) | | | | | |
|---|---|---|---|---|---|---|
| | Ex. I | A | Ex. II | B | Ex. III | C |
| LAS | 6.2 | 6.2 | 6.2 | 6.2 | 6.2 | 6.2 |
| AO | 0.5 | 0.5 | 0.5 | 0.5 | 0.5 | 0.5 |
| TAE-11 | 1.0 | 1.0 | 1.0 | 1.0 | 1.0 | 1.0 |
| STPP | 24.0 | 24.0 | 24.0 | 24.0 | 24.0 | 24.0 |
| Silicate 1.6 | 8.0 | 8.0 | 8.0 | 8.0 | 8.0 | 8.0 |
| Smectite clay | 2.4 | 2.4 | 2.4 | 2.4 | 5.0 | 5.0 |
| Copolymer $AA^{40}/MA^{60}$ | 1.6 | 1.6 | 1.6 | 1.6 | 1.6 | 1.6 |
| DTMA | — | — | 3.8 | 3.8 | 3.0 | 3.0 |
| HFA | — | — | — | — | 1.5 | 1.5 |
| CMC | 0.4 | 0.4 | 0.4 | 0.4 | 0.4 | 0.4 |
| Optical brightener | 0.23 | 0.23 | 0.23 | 0.23 | 0.23 | 0.23 |
| EDTA | 0.2 | 0.2 | 0.2 | 0.2 | 0.2 | 0.2 |
| STS | 0.65 | 0.65 | 0.65 | 0.65 | 0.65 | 0.65 |
| Perborate | 20.0 | 20.0 | 20.0 | 20.0 | 20.0 | 20.0 |
| Aminofunctional polydimethylsiloxane(1) | 2.0 | — | 2.0 | — | 0.5 | — |
| TAE-5 | 0.5 | — | 0.5 | — | 0.2 | — |
| Enzymes | 0.5 | 0.5 | 0.5 | 0.5 | 0.5 | 0.5 |
| Photobleach activator (ppm) | 25 | 25 | 25 | 25 | 25 | 25 |
| Copper-EDTA (ppm) | 30 | 30 | 30 | 30 | 30 | 30 |
| SRS I | 2.7 | 2.7 | 2.7 | 2.7 | 2.7 | 2.7 |
| Perfume/water/sodium | balance to 100 | | | | | |

-continued

| COMPOSITIONS (% by weight) | Ex. I | A | Ex. II | B | Ex. III | C |
|---|---|---|---|---|---|---|
| sulfate | | | | | | |

(1)(N—cyclohexyl-4-amino-butyl-1) polydimethylsiloxane with degree of substitution of 0.15; viscosity 300 centistokes; this polydimethylsiloxane was premixed with the TAE-5.

The compositions of examples I, II, III (invention) were respectively compared for through-the-wash softeness vs. identical compositions A, B, C, which did not contain the aminofunctional polydimethylsiloxane.

The testing conditions were as follows:

Ex. I, A: automatic drum washing machine SAM:TM250 by Brandt Thomsom (France); heating up from 15° C. to 60° C.; +45′ at 60° C.

Ex. II, B: automatic drum washing machine MIELE 423; heating up from 15° C. TO 40° C.; +50′ at 40° C.

Ex. III,C: automatic drum washing machine MIELE 423; heating up from 15° C. to 60° C.; +50′ at 60° C.

1% product concentration in wash liquor;

18 grains/US gallon water hardness (3:1 Ca/Mg ratio).

The washed and dried swatches were compared by a panel of two expert judges, working independently, by a paired comparison technique using a 9-point Scheffe scale. Differences were recorded in panel score units (psu), positive being performancewise better and the least significant difference (LSD) at 95% confidence was also calculated.

The testing results were as follows:

| SOFTNESS (psu) | Example I | vs. | Example A | LSD |
|---|---|---|---|---|
| Terry fabric (12 per test) | +0.9 | | −0.9 | 0.5 |
| | Example II | vs. | Example B | LSD |
| Terry fabric | +0.45 | | −0.45 | 0.7 |
| Acrylic fabric | +0.6 | | −0.6 | 0.4 |
| | Example III | vs. | Example C | LSD |
| Terry fabric | +0.7 | | −0.7 | 0.7 |

These results show the significant softness through-the-wash benefits derivable from inventive compositions I, II, III vs. identical compositions A, B, C which did not contain the aminofunctional polydimethylsiloxane.

An additional composition of this invention, Example IV, was prepared by spray-drying/dry-mixing as described in Example I, the sole difference being that the aminofunctional polydimethylsiloxane used was, (ethylenediamino)-N-butyl-1)-polydimethyl siloxane with degree of substitution of 0.05, viscosity 450 centistokes.

The composition of Example IV (invention) was compared vs. the identical composition D which did not contain the above aminopolydimethylsiloxane. Testing conditions were as described in Example I, and the results are as follows:

| SOFTNESS (psu) | Example IV | vs. | Example D | LSD |
|---|---|---|---|---|
| Terry Towel | +0.75 | | −0.75 | 0.5 |

Hence the softness performance superiority of the claimed technology vs. identical compositions not containing an aminofunctional polydimethyl siloxane was confirmed.

Comparable textile benefits can be secured from detergent compositions which are identical to the compositions of examples I, II and III except for the (N-cyclohexyl-4-amino-butyl1) polydimethylsiloxane which is replaced by the listed organo-functional siloxanes in the stated proportions.

| REPLACEMENT SILOXANE | DEGREE OF SUBSTITUTION | EXAMPLE I | II | III |
|---|---|---|---|---|
| (Ethylenediamino-N—butyl-1)-polydimethylsiloxane | 0.18 | 1.5 | — | — |
| | 0.45 | — | — | 1.2 |
| (N—dodecyl-4-amino-butyl-1)-polydimethylsiloxane | 0.08 | 0.3 | 1.8 | — |
| | 0.20 | — | — | 0.5 |
| (4-(N,N—dimethylammonium)-butyl-1)-polydimethylsiloxane | 0.25 | 0.6 | 1.4 | — |
| | 0.60 | 1.2 | — | 0.8 |
| (5-(tallowamide)-4-carboxy-pentyl-1)-polydimethylsiloxane | 0.05 | 0.4 | — | 2.0 |
| | 0.30 | 0.2 | 1.2 | — |

Additional detergents of this invention are prepared having the following compositions.

| INGREDIENTS | EXAMPLES (% by weight) V | VI | VII | VIII |
|---|---|---|---|---|
| LAS | 6.2 | 6.0 | 6.2 | 8.0 |
| AO | 0.5 | 1.0 | 1.0 | — |
| TAE-11 | 1.0 | 1.0 | 1.0 | 1.0 |
| STPP | 24.0 | 24.0 | 24.0 | 24.0 |
| Silicate 1.6 | 8.0 | 8.0 | 8.0 | 8.0 |
| Smectite clay | 5.0 | 3.0 | 5.0 | 5.0 |
| Copolymer $AA^{40}/MA^{60}$ | 1.6 | 2.0 | 2.0 | 2.5 |
| DTMA | 3.0 | 3.0 | 4.5 | 3.0 |
| HFA | 1.5 | 1.5 | 1.5 | 1.5 |
| Dioctyldimethyl-quaternary ammonium chloride | 1.0 | 2.0 | 0.5 | 0.5 |
| CMC | 0.4 | 0.4 | 0.4 | 0.4 |
| Optical brightener | 0.23 | 0.23 | 0.23 | 0.23 |
| EDTA | 0.2 | 0.2 | 0.2 | 0.2 |
| STS | 0.65 | 0.65 | 0.65 | 1.0 |
| Perborate | 20.0 | 20.0 | 20.0 | 25.0 |
| Aminofunctional polydimethylsiloxane (1) | 2.0 | 2.0 | 1.0 | 4.0 |
| TAE-5 | 0.5 | 0.5 | 0.25 | 1.0 |
| Enzymes | 0.5 | 0.5 | 0.5 | 0.5 |
| Photobleachactivator (ppm) | 25 | 25 | 25 | 25 |
| Copper EDTA (ppm) | 30 | 30 | — | — |
| SRS-I | 2.7 | 3.7 | 3.7 | 4.0 |
| Perfume/water/sodium sulfate | | balance to 100 | | |

| INGREDIENTS | EXAMPLES (% by weight) IX | X | XI | XII |
|---|---|---|---|---|
| LAS | 5.0 | 5.0 | — | 5.0 |
| TAS | 3.0 | — | 2.5 | 3.0 |
| α-OS | — | — | 5.0 | — |
| TAE-11 | 1.0 | 2.5 | — | 1.0 |
| FA 25E7 | — | — | 4.0 | — |
| STPP | 18.0 | 20.0 | 16.0 | 28.0 |
| Zeolite A | — | — | 16.0 | — |
| NTA | 6.0 | — | — | — |
| $Na_3$ Citrate | — | 5.0 | — | — |
| Silicate 1.6 | 6.0 | 6.0 | 2.0 | 6.0 |
| Copolymer $AA^{40}/MA^{60}$ | 1.5 | 2.0 | 2.0 | 1.0 |
| Polyacrylate MW 1000 | 1.0 | 1.5 | 1.0 | 0.5 |
| Polyacrylate MW 2000 | 1.0 | 1.5 | 1.0 | 0.5 |
| DTMA | — | 5.5 | — | — |
| HFA | — | 0.5 | — | — |
| CFA | — | — | 4.0 | — |
| Coconut-trimethyl-quaternary ammonium chloride | — | 2.0 | — | — |
| CMC | — | — | 1.0 | 0.8 |
| Optical brightener | 0.4 | 0.3 | 0.3 | 0.23 |
| EDTA | 0.2 | 0.2 | 0.3 | 0.2 |
| Perborate | 32.0 | — | 28.0 | 28.0 |
| Photobleach activator | 25 ppm | 25 ppm | — | 25 ppm |

-continued

| | | | | |
|---|---|---|---|---|
| Amino functional polydimethyl siloxane (1) | 2.0 | 3.0 | 2.5 | 0.5 |
| TAE-5 | 0.5 | 0.7 | 0.6 | 0.2 |
| SRS-I | 1.5 | 2.7 | 1.5 | 1.2 |
| Enzymes | 0.2 | 0.6 | 0.3 | 0.2 |
| Perfume/water/sodium sulfate | | balance to 100 | | |

| | EXAMPLES (% by weight) | | | |
|---|---|---|---|---|
| INGREDIENTS | XIII | XIV | XV | XIV |
| LAS | 7.0 | 4.5 | 7.0 | 4.5 |
| TAS | — | 2.5 | — | 2.5 |
| A.O | 0.5 | 0.3 | 0.8 | 1.0 |
| TAE-11 | 2.7 | — | 2.7 | — |
| FA 25E7 | — | 2.0 | — | 2.0 |
| STPP | 4.0 | 24.0 | 16.0 | 8.0 |
| Zeolite A | — | — | 16.0 | — |
| NTA | — | 4.0 | — | 6.0 |
| Silicate 1.6 | 5.0 | 5.0 | 2.0 | 2.0 |
| Copolymer $AA^{60}/MA^{40}$ | 5.0 | 1.0 | 2.0 | 3.0 |
| Polyacrylate MW 2000 | 2.0 | 1.0 | 3.0 | 2.0 |
| DTMA | — | 3.0 | 1.5 | — |
| HFA | — | 3.0 | 3.5 | 4.0 |
| CFA | — | 2.0 | — | 2.0 |
| Ethylenediaminetetramethylene phosphonate-$Na^-$ | — | 0.2 | 0.8 | 0.1 |
| Coconut-trimethyl-quaternary ammonium chloride | — | 1.0 | 0.5 | — |
| CMC | 0.8 | 0.8 | 1.0 | 1.0 |
| EDTA | 0.2 | 0.3 | 0.3 | 0.2 |
| Perborate | 32.0 | 28.0 | 30.0 | 28.0 |
| Amino functional polydimethyl siloxane (1) | 0.5 | 3.0 | 4.0 | 2.0 |
| TAE-5 | 0.2 | 0.7 | 1.0 | 0.5 |
| SRS-II | 1.4 | 2.0 | 2.5 | 2.0 |
| Enzymes | 0.2 | 0.2 | 0.3 | 0.2 |
| Perfume/water/sodium sulfate | | balance to 100 | | |

We claim:

1. A particulate built detergent composition capable of providing desirable textile benefits, inclusive of softening, comprising:

(a) from 1% to 30% by weight of a surface-active agent;

(b) from 4% to 40% by weight of a detergent builder; and, (c) optional ingredients inclusive of silicone suds regulant and cationic fabric softeners, containing (d) from 0.05% to 5% by weight of an organo-functional poly-di-$C_{1-4}$ alkyl siloxane textile treatment agent having the general formula:

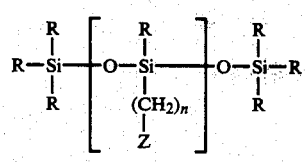

wherein $R = C_{1-4}$-alkyl; n is an integer from 1 to 6;

Z is

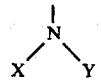

whereby X and Y are, selected independently, —H; —$C_{1-30}$-alkyl; —$C_6$aryl; —$C_{5-6}$-cycloalkyl; —$C_{1-6}$—$NH_2$; —CO—R; with the proviso that the nitrogen can be quaternized such as to represent

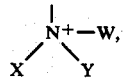

whereby W can be selected from X or Y; or

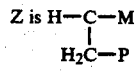

whereby P and M are —COOH; —CO—$NR'_2$; or $C_{1-2}$-alkyl;

with the further provisio that the degree of substitution, i.e., the molar proportion of silicones carrying a substituent other than a $C_{1-4}$-alkyl group to total silicones is in the range from 0.01 to 0.7.

2. The composition in accordance with claim 1 wherein the siloxane represents from 0.1%–3% by weight.

3. The composition in accordance with claim 1 wherein the siloxane is characterized as follows: n is 3 or 4, and X and Y are selected independently from: hydrogen; —$C_{1-4}$-alkyl; —$C_{5-6}$-cycloalkyl; and —$C_{2}$—$NH_2$.

4. The composition in accordance with claim 2 wherein the siloxane has a degree of substitution of from 0.02 to 0.3.

5. The composition in accordance with claim 4 wherein the substituted silicone atoms are non-terminal atoms.

6. The composition in accordance with claim 2 wherein the siloxane component is selected from (N-cyclohexylamino-4-amino-butyl-1)polydimethylsiloxane;

(Ethylene diamino-N-butyl-1)polydimethylsiloxane;

(N-dodecyl-4-amino-butyl-1)polydimethylsiloxane;

(4-(N,N-dimethyl ammonium)-butyl-1)polydimethylsiloxane; and (5-(tallow amide)-4-carboxy-pentyl-1)polydimethylsiloxane.

7. The composition of claim 1 wherein there is at least 2% surface-active agent and 8% detergent builder.

8. The detergent composition of claim 1 containing from 2% to 10% surface-active agent and from 8% to 35% detergent builder.

* * * * *